US007628653B2

(12) United States Patent
Zhang et al.

(10) Patent No.: US 7,628,653 B2
(45) Date of Patent: Dec. 8, 2009

(54) ELECTRICAL CARD CONNECTOR WITH IMPROVED CARD RESTRICTION STRUCTURE

(75) Inventors: Shi-Gui Zhang, Kunshan (CN); Qi-Jun Zhao, Kunshan (CN); Hua Yin, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/291,414

(22) Filed: Nov. 10, 2008

(65) Prior Publication Data

US 2009/0275239 A1 Nov. 5, 2009

(30) Foreign Application Priority Data

Nov. 9, 2007 (CN) ..... 2007 2 0042126 U

(51) Int. Cl.
*H01R 24/00* (2006.01)

(52) U.S. Cl. ..... 439/630

(58) Field of Classification Search ..... 439/325–326, 439/630, 947

See application file for complete search history.

(56) References Cited

U.S. PATENT DOCUMENTS

| | | | | |
|---|---|---|---|---|
| 6,994,574 | B1 | 2/2006 | Lai | |
| 7,083,473 | B1 | 8/2006 | Lai | |
| 7,198,497 | B1 * | 4/2007 | Lai et al. | 439/159 |
| 7,220,138 | B2 * | 5/2007 | Miyamoto | 439/159 |
| 7,275,964 | B2 * | 10/2007 | Ting et al. | 439/630 |

* cited by examiner

*Primary Examiner*—Khiem Nguyen
(74) *Attorney, Agent, or Firm*—Wei Te Chung; Andrew C. Cheng; Ming Chieh Chang

(57) ABSTRACT

An electrical card connector includes an insulative housing defining a card receiving space and a plurality of contacts for mating with a first card and a second card wider than the first card. A card restriction member is fixed to the insulative housing and includes a deformable main body upwardly extending into the card receiving space. The main body includes a pair of raised portions protruding upwardly beyond a guiding surface thereof with a depression formed between said pair of raised portions. With insertion of the first and the second cards into the card receiving space, the first card is received in the depression and restricted by the raised portions, and the second card is restricted by the side walls of the insulative housing for stable guiding insertion.

10 Claims, 11 Drawing Sheets

ELECTRICAL CARD CONNECTOR WITH IMPROVED CARD RESTRICTION STRUCTURE

BACKGROUND OF THE INVENTION

1. Field of the Invention

The present invention relates to electrical card connectors, more particularly to electrical card connectors with improved card restriction structure for restricting and guiding insertion of corresponding cards.

2. Description of Related Art

Nowadays, memory cards are widely used in electronic devices. There are many kinds of memory cards such as MMC (Multi Media) card, SD (Secure Digital) card, xD (xD-Picture) card, MS (Memory Stick) card and MS (Memory Stick) Duo card. According to the standard specification, the dimension of the MS card is 50 mm×21.5 mm×2.8 mm and the dimension of the MS Duo card is 31 mm×20 mm×1.6 mm. It is obvious that the MS card is much wider and thicker than the MS Duo card.

Electrical card connectors are usually mounted on a PCB of the electronic devices to establish data transmission between the memory cards and the electronic devices. It is a common knowledge to those of ordinary skill in the art to know that both the MS card and the MS Duo card are compatible to a MS card connector or a multiple-in-one card connector having MS card contacts disclosed in U.S. Pat. No. 6,994,574. Such card connectors only defines a wide slot for guiding insertion of the MS card. However, when the MS Duo card is inserted along the slot, it may be rock along a left-to-right direction because the MS Duo card is much narrower than the MS card. As a results, signal transmission is terribly affected.

Hence, an improved electrical card connector with improved card restriction structure is needed to solve the problem above.

BRIEF SUMMARY OF THE INVENTION

An electrical card connector includes an insulative housing and a plurality of contacts retained in the insulative housing for mating with a first card and a second card which is wider than the first card. The insulative housing includes a front mating face and a card receiving space recessed from the front mating face for receiving the first and the second cards. The insulative housing includes a pair of side walls with the receiving space formed therebetween. Each contacts includes a contact portion extending into the card receiving space. A card restriction member is fixed to the insulative housing and includes a deformable main body upwardly extending into the card receiving space. The main body includes an inclined guiding surface and a pair of raised portions protruding upwardly beyond the guiding surface with a depression formed between said pair of raised portions. The first card is received in the depression and restricted by the raised portions when the first card is inserted into the card receiving space. The second card abuts against upper surfaces of the raised portions and is restricted by the side walls of the insulative housing when the second card is inserted into the card receiving space. As a result that both of the first and the second card can be sidewardly restricted by corresponding structures for stable insertion.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 5:
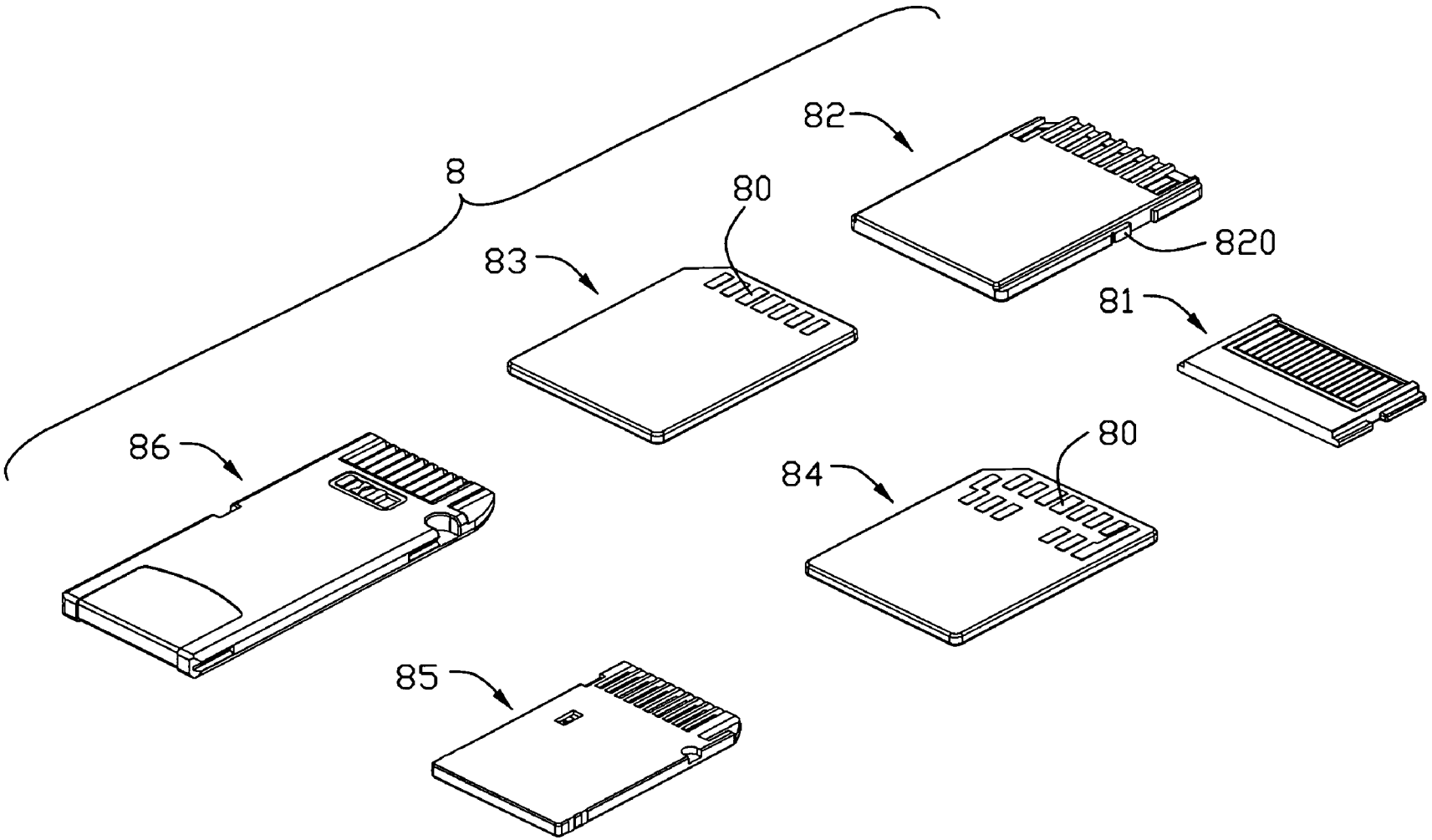
FIG. 5 is another perspective view of the cards, but taken from another aspect.
Figure 6:
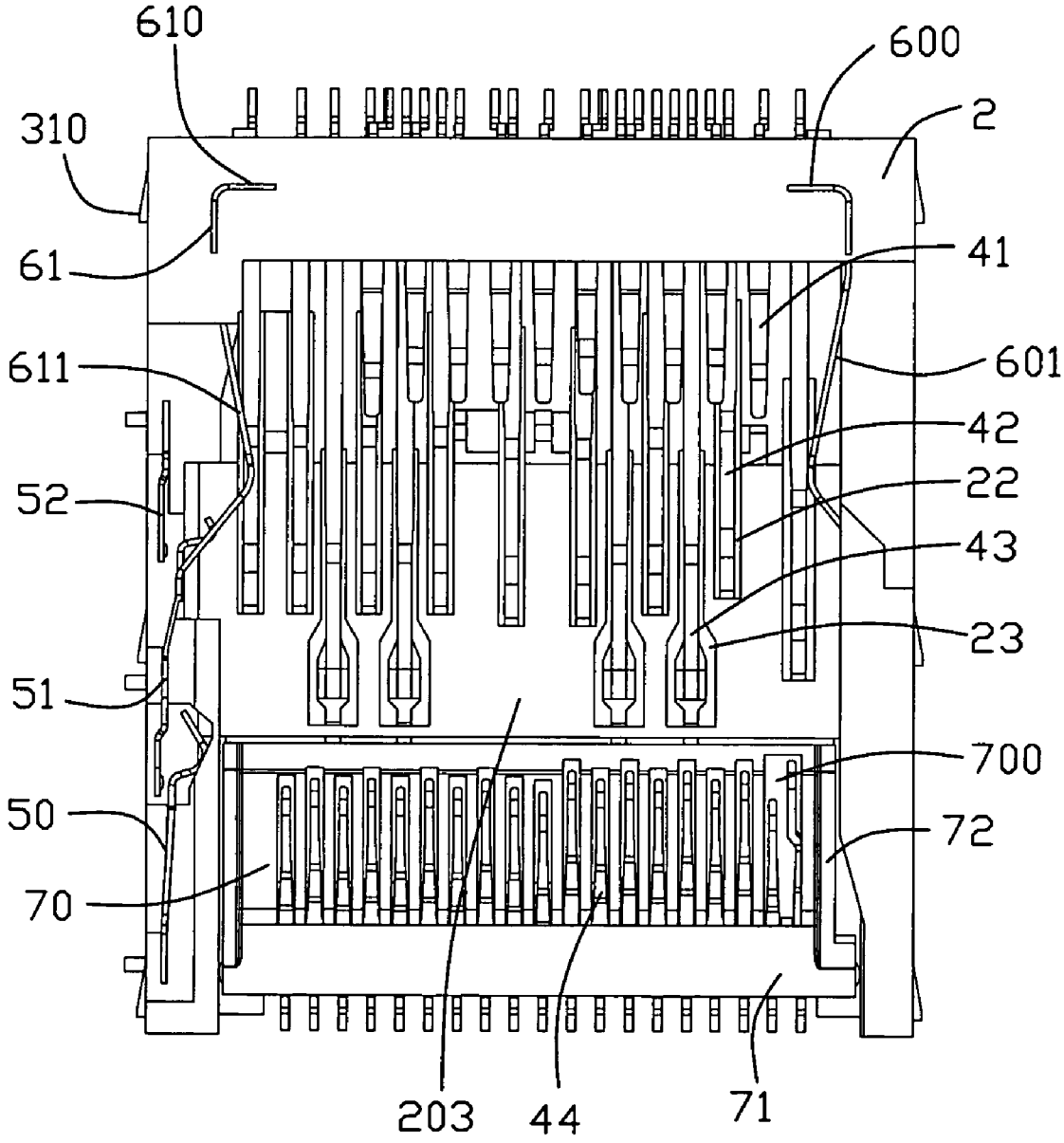
FIG. 6 is a top view of the electrical card connector with the metal shell removed therefrom.
Figure 7:
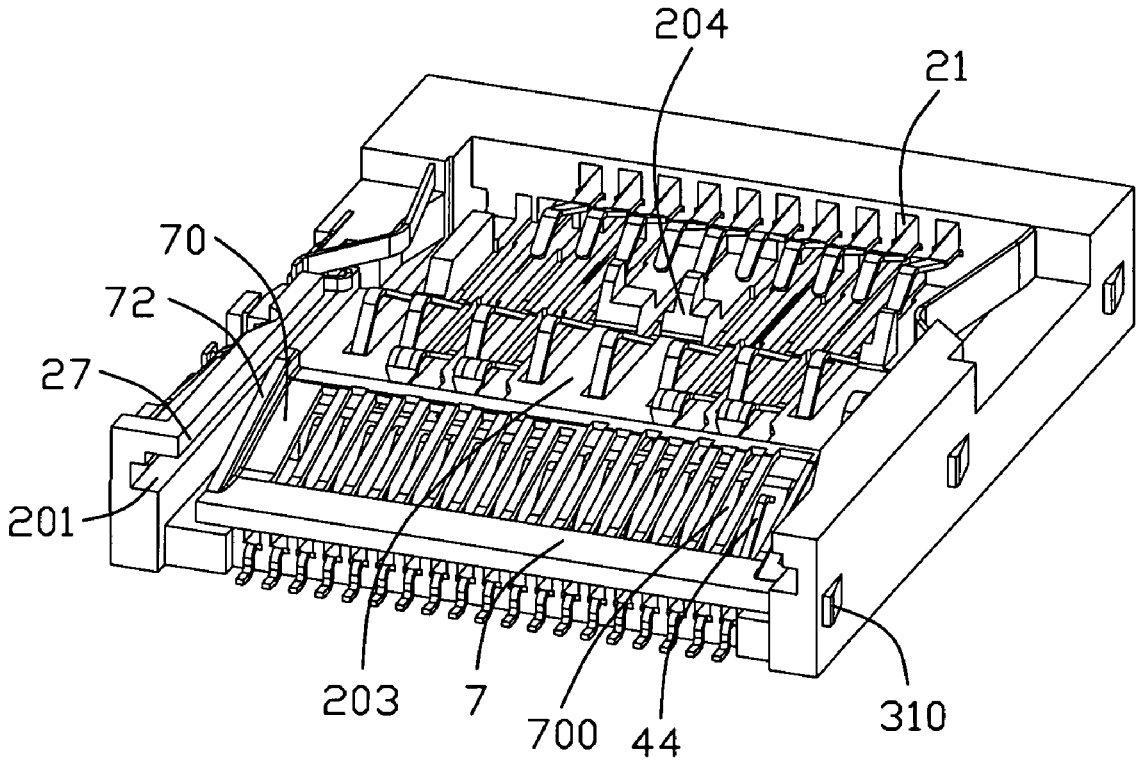
FIG. 7 is a perspective view of FIG. 6.
Figure 8:
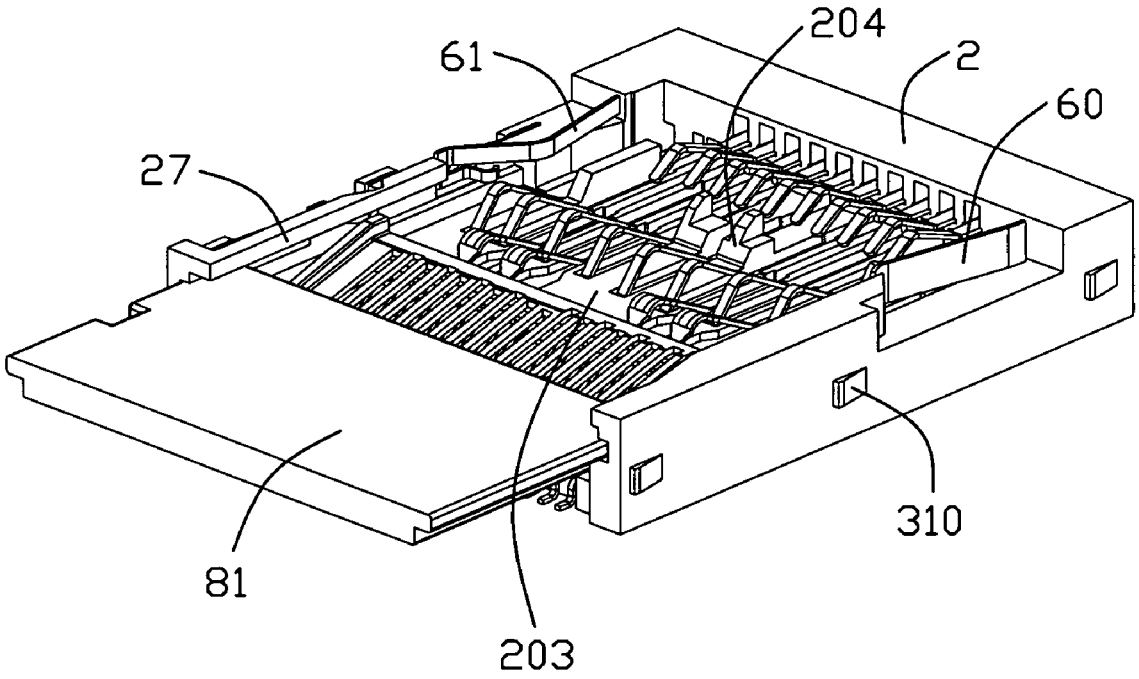
FIG. 8 is a perspective view of the electrical card connector before full insertion of the xD card.

Referring to FIGS. 1-8, an electrical card connector 100 for being mounted on a PCB (not shown) can be used for insertion of many kinds of cards 8 such as xD card 81, SD card 82, MMC card 83, MMCplus card 84, MS card 85 and MS Duo card 86, as best shown in FIGS. 5 and 6. It is a common knowledge that the MS card 85 is wider, thicker and longer than the MS Duo card 86. In order to simplify description hereinafter, the MS Duo card 86 is also named the first card 85, and the MS card 85 is named the second card 85. All the cards 8 include flat contact pads 80 for electrically mating with the electrical card connector 100. The electrical card connector 100 includes an insulative housing 2, a plurality of contacts for mating with contact pads 80 of the cards 8, a metal shell 3 covering the insulative housing 2 and a switch contact group 5. The contacts are divided into a first contact group 41, a second contact group 42, a third contact group 43 and a fourth contact group 44 arranged along the card insertion direction as shown FIG. 2.

The insulative housing 2 includes a rear wall 26, a pair of side walls 27, 28 extending forwardly from lateral sides of the rear wall 26 and a bottom wall 203 connecting the rear wall 26 and the pair of side walls 27, 28. The insulative housing 2 further includes a front mating face 25 opposite to the rear wall 26 with a card receiving space 20 recessed from the mating face 25 and extending backwardly. The receiving space 20 is located between the side walls 27, 28. Each side wall 27, 28 defines a guiding slot 201 communicating with the receiving space 20 for receiving the cards 8. The contacts include a plurality of contact portions protruding into the receiving space 20 for mating with the cards 8. The rear wall 26 defines a plurality of first passageways 21 for receiving the first contact group 41. The bottom wall 203 defines a plurality of second passageways 22, third passageways 23 and fourth passageways 24 positioned along a rear-to-front direction in turn for receiving the second, third and fourth contact groups 42, 43, 44, respectively. A plurality of protrusions 204 are located forward the first contact group 41 and further upwardly extend into the receiving space 20 for preventing another card from being inserted.

The fourth contact group 44 includes a plurality of front contacts arranged adjacent to the mating face 25. Each front contact includes a front contact portions 441 cantileveredly extending into the receiving space 20 and a front soldering tail 442 extending from the front contact portion and further extending beyond the mating face 25 of the insulative housing 2.

Figure 1:
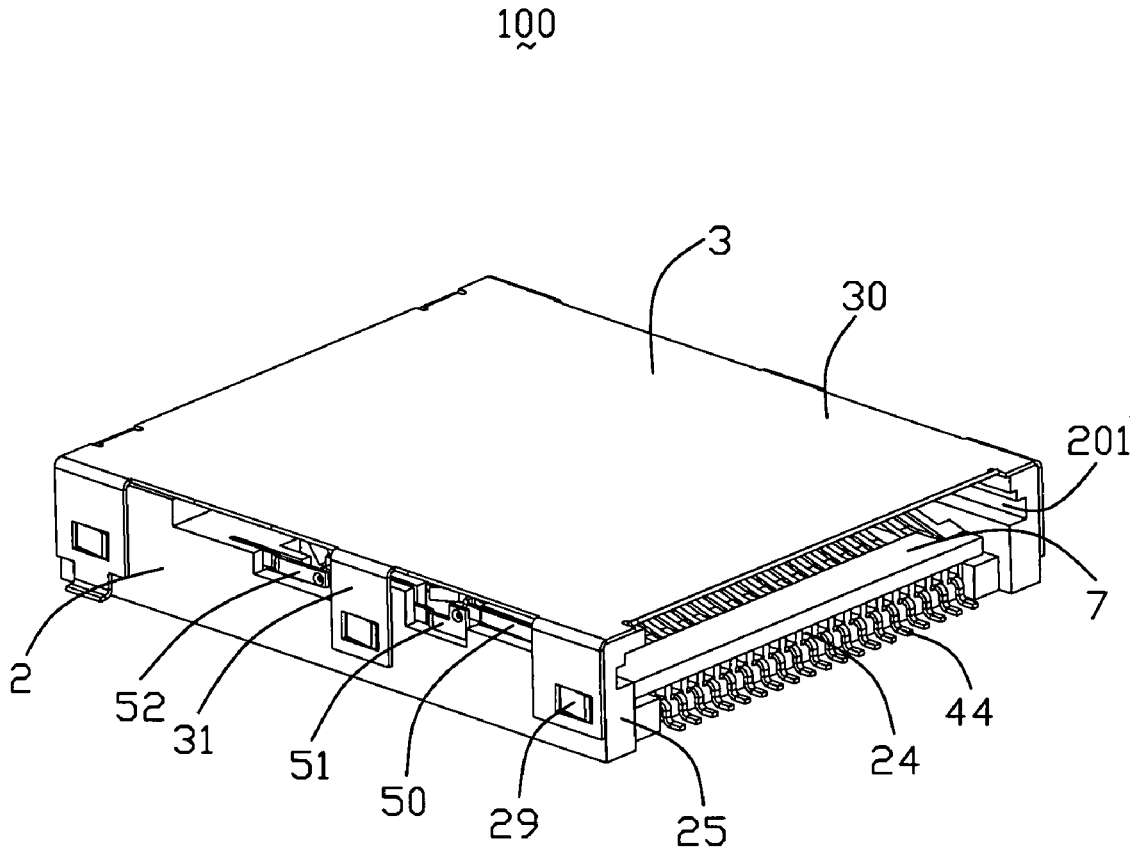
FIG. 1 is a perspective view of an electrical card connector according to a first embodiment of the present invention.
Figure 2:
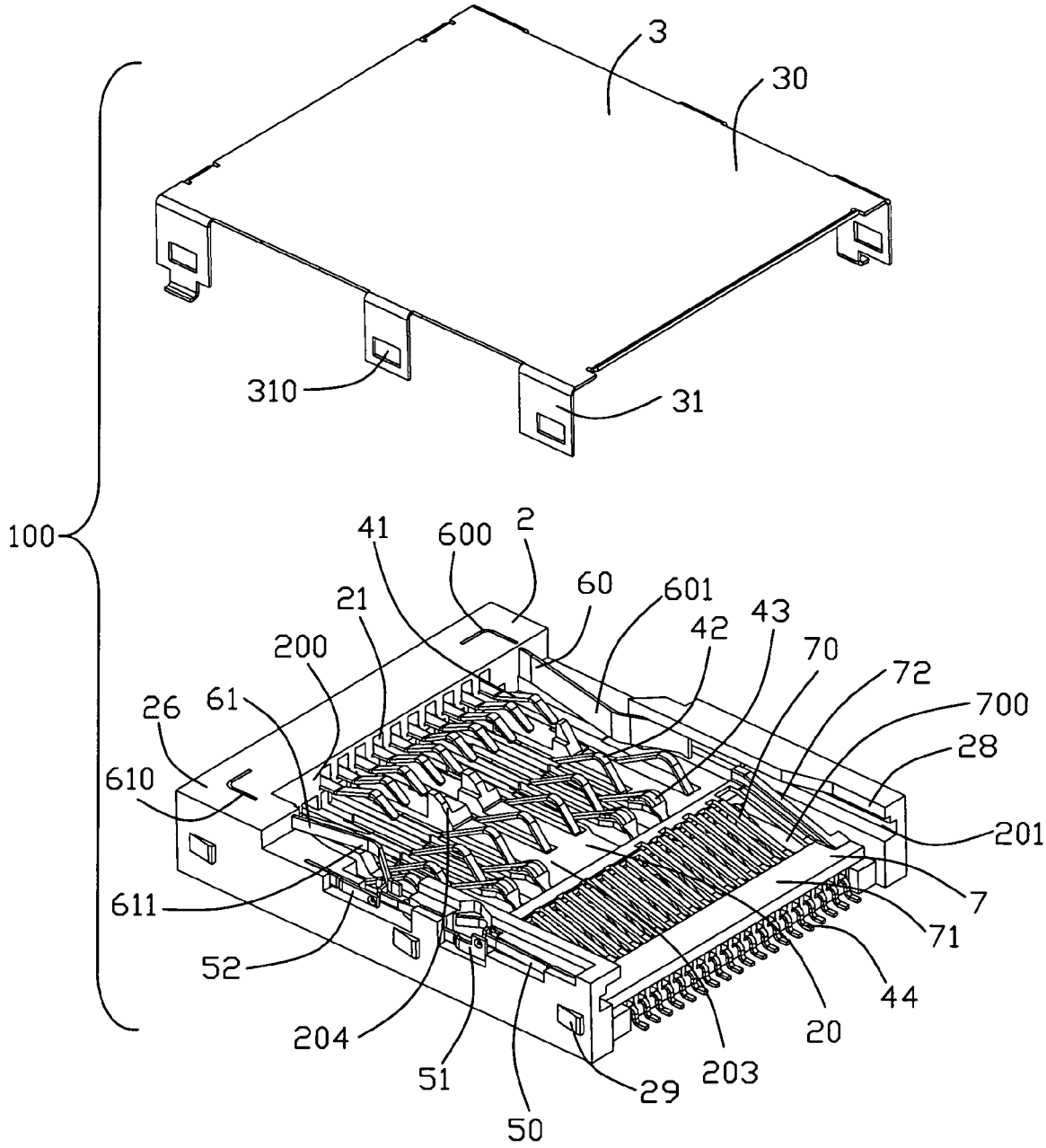
FIG. 2 is a part exploded view of the electrical card connector.
Figure 3:
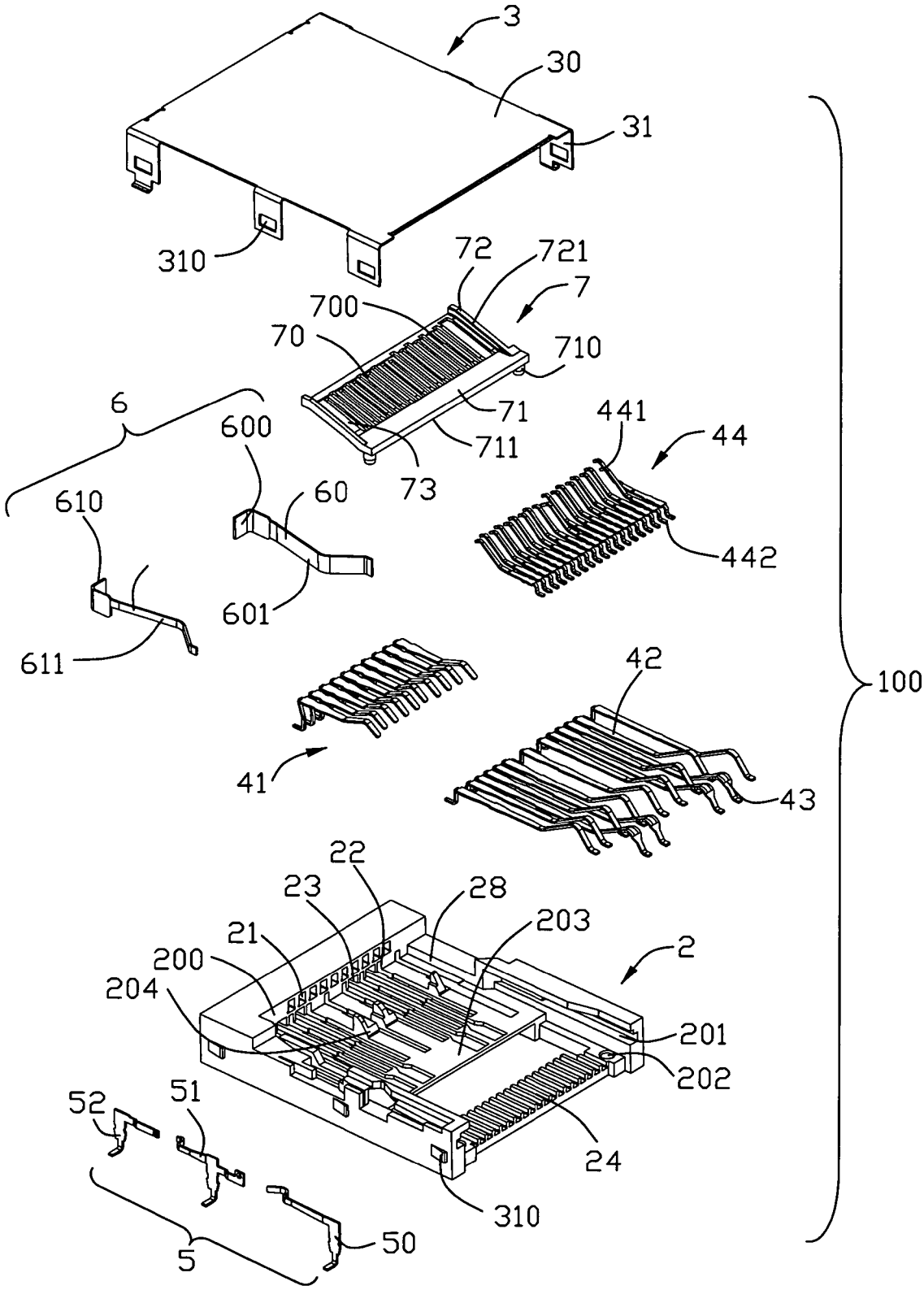
FIG. 3 is an exploded view of the electrical card connector, but taken from another aspect.
Figure 4:
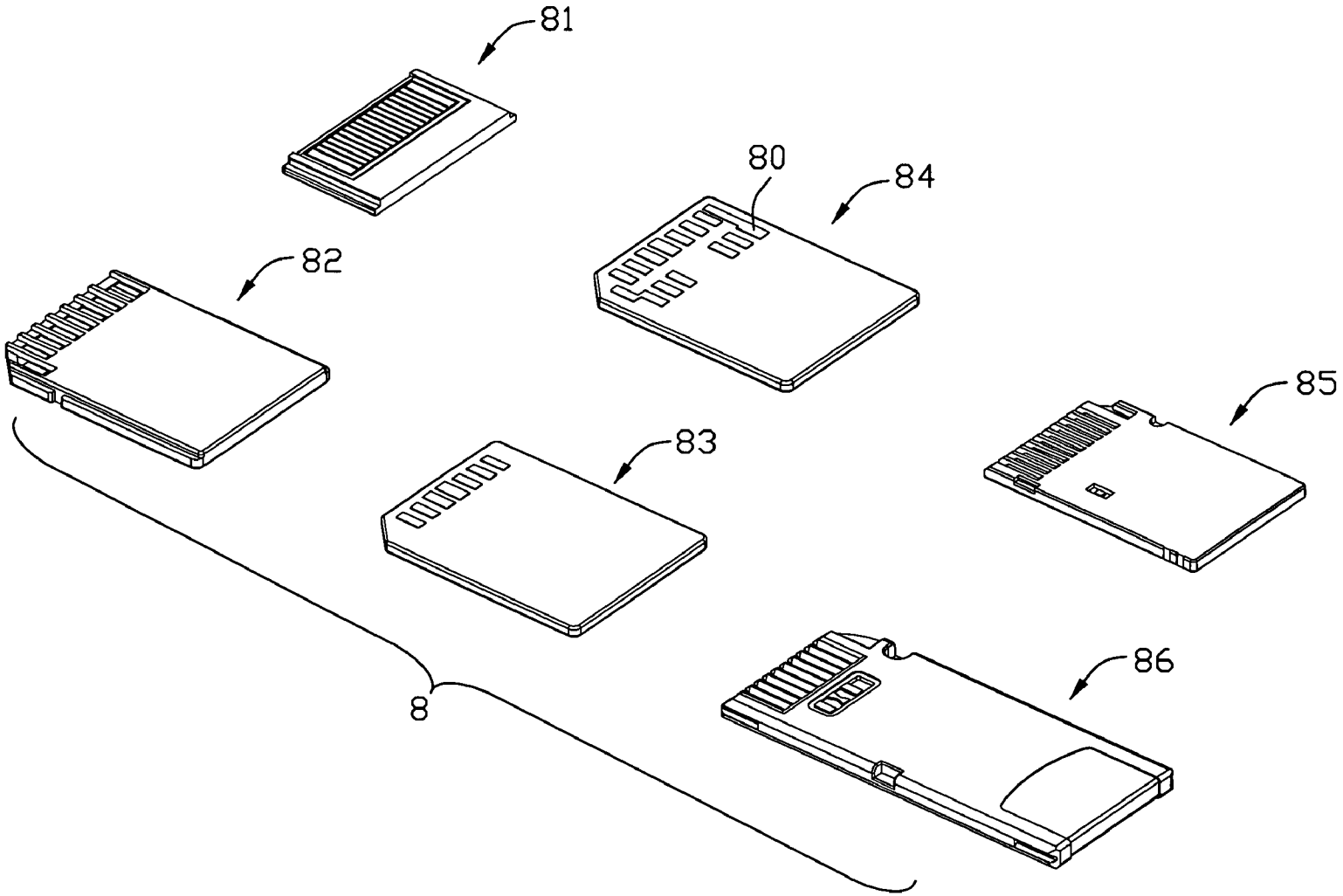
FIG. 4 is a perspective view of six kinds of cards which can be inserted into the electrical card connector.

Referring to FIGS. 2 and 3, in order to firmly retain the cards 8 in the receiving space 20, the card connector 100 further includes a spring member 6 which further includes a pair of first and second clip contacts 60, 61. The first clip contact 60 includes a L-shaped first retaining portion 600 and a first spring portion 601 extending forwardly from the first retaining portion 600. The second clip contact 61 includes a L-shaped second retaining portion 610 and a second spring portion 611 extending forwardly from the second retaining portion 610. The first and the second spring portions 601, 611 are located on lateral sides of the first contact group 41 for abutting against the first and the second cards 86, 85.

Referring to FIGS. 2, 3 and 6, the switch contact group 5 includes a first switch contact 50, a second switch contact 51 and a third switch contact 52 jointly for detecting insertion of the cards 8. The switch contact group 5 is widely used in card connector, so detailed description is omitted hereinafter.

Referring to FIGS. 2, 3 and 6-9, in order to limit both the first and the second cards 86, 85 when such cards are inserted into the receiving space 20, the card connector 100 further includes a card restriction member 7. According to the first embodiment of the present invention, the restriction member 7 includes a base 71 fixed to the bottom wall 203 of the insulative housing 2 and a deformable main body 70 integrally extending from the base 71. The base 71 includes a flat mounting surface 711 attached to the bottom wall 203 and a pair of mounting posts 710 extending downwardly from the mounting surface 711 to be received in corresponding holes 202 of the bottom wall 203. The main body 70 is made from elastic material and is deformable with respect to the base 71 due to its own elasticity. The main body 70 upwardly extends into the receiving space 20 and includes an upward inclined guiding surface 73, a pair of raised portions 72 extending upwardly from lateral sides of the guiding surface 73 and a plurality of side-by-side slots 700 throughout the guiding surface 73. The front contact portions 441 selectively extends through the slots 700 duo to deformation of the main body 70.

When the first card 86 is inserted into the receiving space 20, the first card 86 is supported by the guiding surface 73 and is located between a depression formed between the pair of raised portions 72. The first card 86 is sidewardly restricted by the pair of raised portions 72, so that the first card 86 can't rock along a left-to-right direction. When the second card 85 is inserted into; the receiving space 20, the bottom surface of the second card 85 abuts against upper surfaces 721 (shown in FIG. 3) of the raised portions 72. The lateral sides of the second card 85 are restricted by the side walls 27, 28 of the insulative housing 2 so that the second card 85 can't rock along the left-to-right direction as well. The main body 70 is pressed by the first or the second cards 86, 85 and is deformable along a vertical direction. The first and the second cards 86, 85 can be clipped by the first and the second spring portions 601, 611 for firmly retention.

When the xD card 81 is inserted along the guiding slots 201 and into the receiving space 20, the bottom surface of xD card 81 is supported by the upper surfaces 721 of the raised portions 72 and downwardly presses the main body 70. As a result that the front contact portions 441 upwardly extend through the slots 700 to mechanically mate with the contact pads 81 of the xD card 81.

The metal shell 3 includes a rectangular top wall 30 and a pair of sides walls 31 extending downwardly from lateral sides of the top wall 30. Each side wall 31 defines a plurality of positioning holes 310 for receiving positioning protrusions 29 of the insulative housing 2 so that the metal shell 3 can be firmly attached to the sidewalls 27, 28 of the insulative housing 2.

Figure 9:
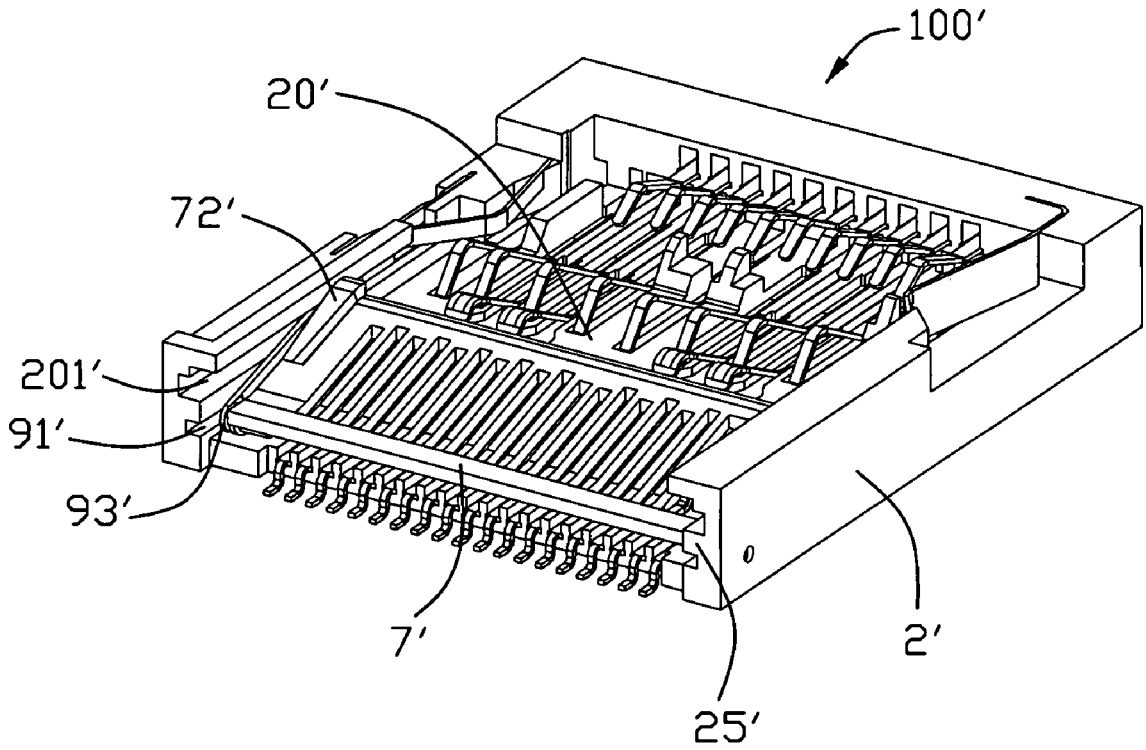
FIG. 9 is a perspective view of the electrical card connector with the metal shell removed therefrom according to a second embodiment of the present invention.
Figure 10:
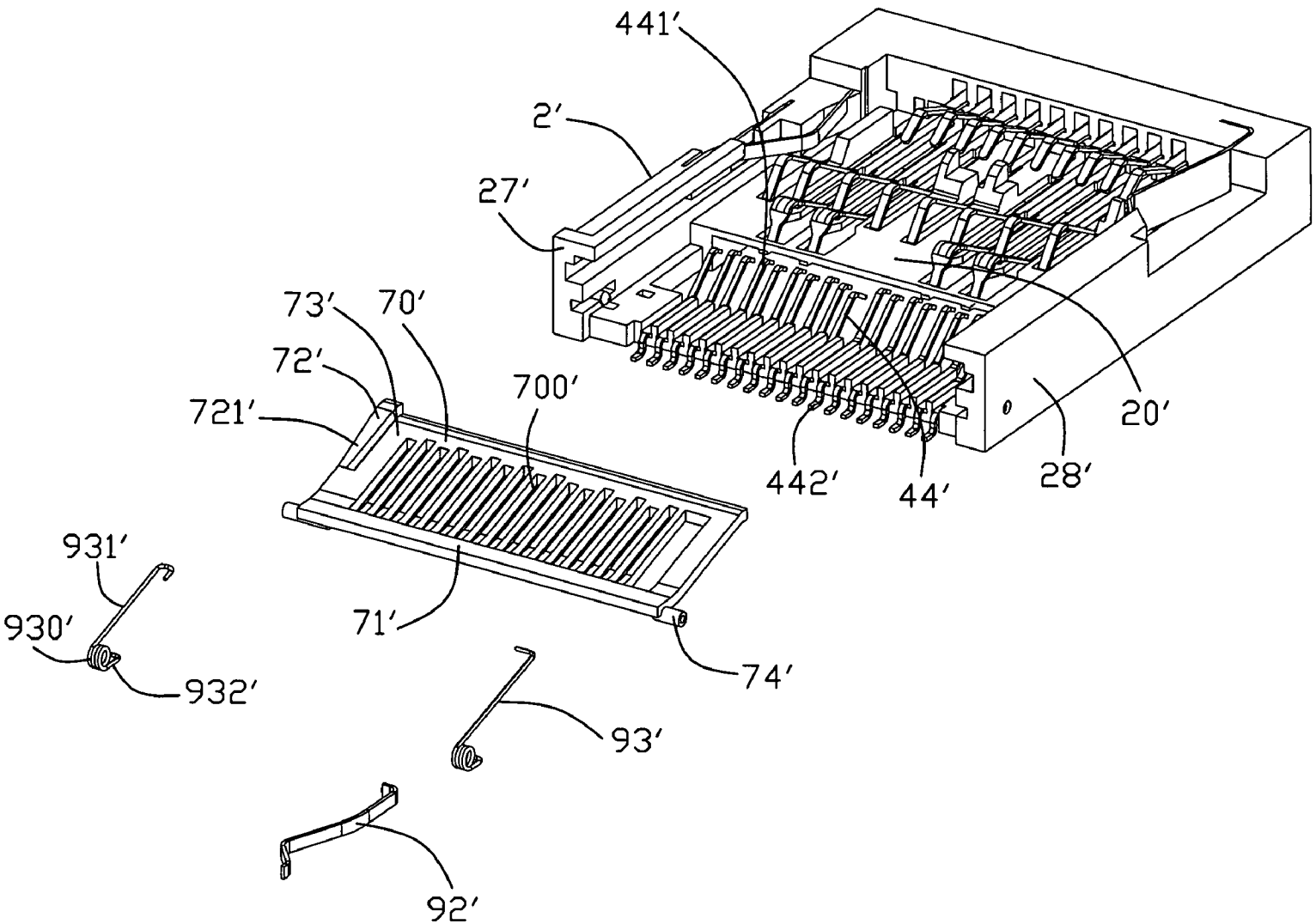
FIG. 10 is an exploded view of the electrical card connector shown in FIG. 9.
Figure 11:
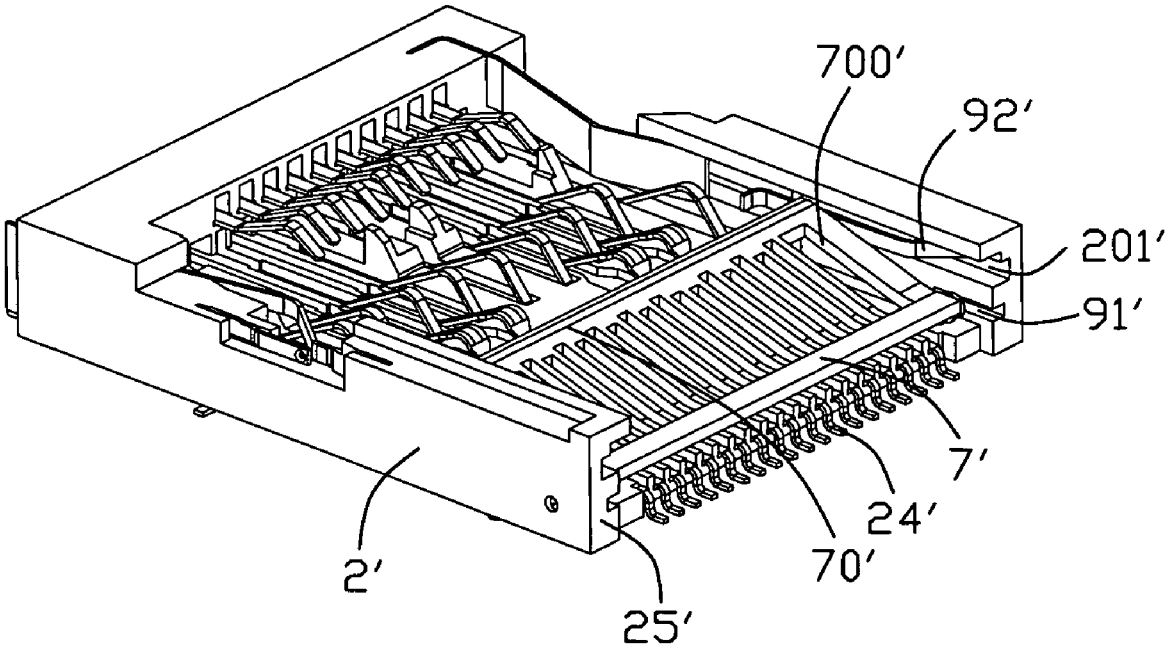
FIG. 11 is another perspective view of the electrical card connector of FIG. 9, while taken from another aspect.

Referring to FIGS. 9-11, a card connector 100' according to another embodiment of the present invention is disclosed. The card connector 100' is similar to the card connector 100 of the first embodiment. The difference between them is the structure of the card restriction member 7, 7'. The card restriction member 7' is rotatablely mounted on the insulative housing 2' and includes a mounting portion 71' and a main body 70' upwardly extending into the card receiving space 20'. The main body 70' includes a raised portion 72' protruding upwardly beyond the inclined guiding surface 73'. The raised portion 72' is disposed on a lateral side of the main body 70' and located adjacent to the first side wall 27'. A metal spring 92' is mounted in the corresponding guiding slot 201' of the second side wall 28' and further extending into the receiving space 20'. The raised portion 72' and the spring 92' are adapted for jointly restricting lateral sides of the first card 86. The mounting portion 71' further includes a pair of pivots 74' opposite extending from lateral sides of the mounting portion 71'. The side walls 27', 28' of the insulative housing 2' each includes a slit 91' extending through the front mating face 25' to receive the pivots 74'. The card connector 100' further includes a pair of elastic springs 93' each including a coiled portion 930' and a pair of first and second abutting portions 931', 932' extending from opposite ends of the coiled portion 930'. In assembly, the pivots 74' are received in the coiled portions 930' with the first and the second abutting portions 931', 932' resisting the main body 70' and the side walls 27', 28, respectively, in order to provide reasonable elasticity. The main body 70' defines a plurality of side-by-side slots 700' extending through the guiding surface 73'. A plurality of front contacts 44' are mounted adjacent to the mating face 25' and located under the main body 70' before insertion of the corresponding cards. Each front contact 44' includes a cantilevered front contact portion 441' selectively extending upwardly through the slots 700' and a front soldering tail 442' extending from the front contact portion 441' and further extending beyond the mating face 25' of the insulative housing 2'.

Similar to the first embodiment, when the first card 86 is inserted into the receiving space 20', it is sidewardly restricted by the raised portion 72' and the spring 92' so that the first card 86 can't rock along a left-to-right direction. When the second card 85 is inserted into the receiving space 20', the bottom surface of the second card 85 abuts against an upper surface 721' (shown in FIG. 10) of the raised portion 72'. The lateral sides of the second card 85 are restricted by the side walls 27', 28' of the insulative housing 2' so that the second card 85 can't rock along the left-to-right direction as well.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical card connector for insertion of a first card and a second card which is wider than the first card, comprising: an insulative housing defining a front mating face and a card receiving space recessed from the front mating face for receiving the first and the second cards; a plurality of contacts with contact portions extending into the card receiving space for mating with the first and the second cards; and a card restriction member fixed to the insulative housing and comprising a deformable main body upwardly extending into the card receiving space, the main body comprising an inclined guiding surface and a pair of raised portions protruding upwardly beyond the guiding surface with a depression formed between said pair of raised portions, under a condition that the first card is received in the depression and restricted by the raised portions with insertion of the first card into the card receiving space, and the second card abuts against upper surfaces of the raised portions with insertion of the second card into the card receiving space, wherein the insulative housing includes a pair of side walls with the card receiving space located therebetween, the second card being restricted by said pair of side walls when the second card is inserted into the card receiving space, wherein the insulative housing comprises a bottom wall under the card receiving space, the card restriction member comprising a base integral with main body, and wherein the base comprises a flat mounting surface attached to the bottom wall, wherein the base comprises a pair of mounting posts extending downwardly from the flat mounting surface, the bottom wall defining a pair of holes to receive said pair of mounting posts.

2. The electrical card connector as claimed in claim 1, wherein the first card is supported by the guiding surface for being inserted into the card receiving space, and the second card is located over the guiding surface with insertion of the second card into the card receiving space.

3. The electrical card connector as claimed in claim 1, wherein the second card is a MS card and the first card is a MS Duo card, the second card being thicker than the first card.

4. The electrical card connector as claimed in claim 1, wherein the main body is deformable with insertion of the first and the second cards due to its own elasticity.

5. The electrical card connector as claimed in claim 1, wherein the restriction member defines a plurality of side-by-side slots extending through the guiding surface, and the plurality of contacts comprising a plurality of front contacts with front contact portions selectively extending upwardly through the slots.

6. The electrical card connector as claimed in claim 5, wherein the front contacts comprise a plurality of front soldering tails extending from the front contact portions and further extending beyond the front mating face of the insulative housing.

7. The electrical card connector as claimed in claim 1, further comprising a pair of clip contacts disposed on lateral sides of the contact portions for clipping the first and the second cards.

8. An electrical card connector for insertion of a first card and a second card which is wider than the first card, comprising: an insulative housing defining a front mating face and a card receiving space recessed from the front mating face for receiving the first and the second cards; a plurality of contacts with contact portions extending into the card receiving space for mating with the first and the second cards; a pair of elastic springs each including a coiled portion and a pair of first and second abutting portions extending from opposite ends of the coiled portion; and a rotatable card restriction member including a main body upwardly extending into the card receiving space and a pair of pivots extending from lateral sides of the main body to be received through the coiled portions, the first and the second abutting portions abutting against the main body and the insulative housing, respectively; and wherein the main body comprises an inclined guiding surface and a raised portion protruding upwardly beyond the guiding surface, under a condition that the first card is sidewardly restricted by the raised portion with insertion of the first card into the card receiving space, and the second card abuts against an upper surface of the raised portion with insertion of the second card into the card receiving space, wherein the insulative housing includes a pair of side walls with the card receiving space located therebetween, the second card being restricted by said pair of side walls when the second card is inserted into the card receiving space, wherein the first and the second abutting portions abut against the main body and the side walls, respectively wherein the main body defines a plurality of side-by-side slots extending through the guiding surface, and the plurality of contacts comprising a plurality of front contacts with front contact portions selectively extending upwardly through the slots, wherein one of the side walls defines a guiding slot communicating with the card receiving space, the electrical card connector further comprising a metal spring mounted in the guiding slot and protruding into the card receiving space, and wherein lateral sides of the first card are sidewardly restricted by the raised portion and the metal spring.

9. The electrical card connector as claimed in claim 8, further comprising a pair of clip contacts disposed on lateral sides of the contact portions for clipping the first and the second cards.

10. An electrical card connector assembly for use with first and second cards, comprising: an insulative housing defining a front mating face and a card receiving space behind the front mating face for receiving at least first and second cards mutually exclusively; a plurality of contacts disposed within the housing with contacting sections extending into the card receiving space; an Up-and-down moveable card restriction member positioned in the card receiving space adjacent to the front mating face, some of said contacts located under said card restriction member, said card restriction member including a main body defining a plurality of juxtaposed slots in a front-to-back direction and in alignment with the corresponding ones of said some of the contacts in a vertical direction;

said main body defining an upper abutment face at an upper level and a lower abutment face at the lower level, respectively, wherein the upper abutment face supports the first card during insertion of the first card; the second abutment face supports the second card during insertion of the second card, wherein said card restriction member defines a stop between the upper abutment face and the lower abutment face so as to guidably receive said second card to restrict lateral movement of the second card thereof, wherein during insertion of one of said first card and said second card, said card restriction member is either still to hide said some of the contacts or moveable to expose said some of the contacts, wherein said card restriction member is moveable via either deflection or rotation.

* * * * *